US008616031B2

(12) United States Patent
Ullrich et al.

(10) Patent No.: US 8,616,031 B2
(45) Date of Patent: Dec. 31, 2013

(54) INTERCHANGEABLE ELECTRONIC LOCK

(75) Inventors: Theodore Ullrich, Brooklyn, NY (US); John McLeod, Toronto (CA); Tonino Sabelli, Oakville (CA); Dean Dipietro, Toronto (CA); Pepin Gelardi, Brooklyn, NY (US)

(73) Assignee: Wesko Systems Limited, Mississauga, Ontario (CA)

( * ) Notice: Subject to any disclaimer, the term of this patent is extended or adjusted under 35 U.S.C. 154(b) by 0 days.

(21) Appl. No.: 13/468,240

(22) Filed: May 10, 2012

(65) Prior Publication Data

US 2013/0298619 A1 Nov. 14, 2013

(51) Int. Cl.
*E05B 47/00* (2006.01)
*E05B 65/44* (2006.01)

(52) U.S. Cl.
USPC ..... 70/279.1; 70/78; 70/278.7

(58) Field of Classification Search
USPC ..... 70/77, 78, 275, 276, 277, 278.1, 278.2, 70/278.3, 278.6, 278.7, 279.1, 280, 283.1; 292/199, 201, 278–280
See application file for complete search history.

(56) References Cited

U.S. PATENT DOCUMENTS

| | | | | |
|---|---|---|---|---|
| 4,213,118 | A | 7/1980 | Genest et al. | |
| 4,887,445 | A | 12/1989 | Beatty | |
| 4,931,789 | A | 6/1990 | Pinnow | |
| 4,967,305 | A | 10/1990 | Murrer et al. | |
| 5,020,345 | A | 6/1991 | Gartner et al. | |
| 5,021,776 | A | 6/1991 | Anderson et al. | |
| 5,033,282 | A | 7/1991 | Gartner et al. | |
| 5,153,561 | A | 10/1992 | Johnson | |
| 5,223,829 | A | 6/1993 | Watabe | |
| 5,265,452 | A * | 11/1993 | Dawson et al. | 70/278.3 |
| 5,321,963 | A | 6/1994 | Goldman | |
| 5,367,295 | A | 11/1994 | Gokcebay et al. | |
| 5,475,375 | A | 12/1995 | Barrett et al. | |
| 5,479,151 | A | 12/1995 | Lavelle et al. | |
| 5,552,777 | A | 9/1996 | Gokcebay et al. | |
| 5,816,084 | A | 10/1998 | Clark | |
| 5,857,365 | A * | 1/1999 | Armstrong | 70/279.1 |

(Continued)

FOREIGN PATENT DOCUMENTS

| | | | |
|---|---|---|---|
| CA | 2388230 | | 11/2003 |
| WO | 2005/017293 | A1 | 2/2005 |
| WO | 2006/114330 | A2 | 11/2006 |
| WO | 2010/124851 | A1 | 11/2010 |

OTHER PUBLICATIONS

Theodore Ullrich et al., U.S. Appl. No. 13/468,219, filed May 10, 2012.

*Primary Examiner* — Christopher Boswell
(74) *Attorney, Agent, or Firm* — Squire Sanders (US) LLP

(57) ABSTRACT

An electronic lock is interchangeable with mechanical locks in retrofit applications or as an OEM lock. The lock includes interchangeable modular components. The lock housing is interchangeable with other housings of different configurations to permit replacement of existing mechanical locks. The lock may also include interchangeable drivers for compatibility with other systems. The lock includes an electronic access system such as a programmable keypad or card reader to activate a motor which powers the electronic lock. An optional manual bypass allows an operator to override the electronic access, for example when the motor is inoperative. When the lock is activated, the operator manually cranks a lock shaft to lock and unlock a storage unit. An optional modular chassis assembly includes a removable array of components for testing, maintenance and repair.

23 Claims, 26 Drawing Sheets

(56) References Cited

U.S. PATENT DOCUMENTS

| | | | | |
|---|---|---|---|---|
| 5,886,644 | A | 3/1999 | Keskin et al. | |
| 5,894,277 | A | 4/1999 | Keskin et al. | |
| 6,000,609 | A | 12/1999 | Gokcebay | |
| 6,016,677 | A | 1/2000 | Clark | |
| 6,116,067 | A * | 9/2000 | Myers et al. | 70/279.1 |
| D438,447 | S | 3/2001 | Gartner | |
| 6,244,084 | B1 * | 6/2001 | Warmack | 70/278.1 |
| D452,807 | S | 1/2002 | Gartner | |
| 6,374,653 | B1 | 4/2002 | Gokcebay et al. | |
| 6,434,987 | B1 | 8/2002 | Juillerat et al. | |
| D484,390 | S | 12/2003 | Abernethy et al. | |
| 6,655,180 | B2 | 12/2003 | Gokcebay et al. | |
| 6,722,167 | B1 * | 4/2004 | Hsu | 70/78 |
| 6,730,867 | B2 | 5/2004 | Hyp | |
| 6,739,164 | B2 * | 5/2004 | Warmack | 70/257 |
| 6,826,935 | B2 | 12/2004 | Gokcebay et al. | |
| D501,388 | S | 2/2005 | Carpintero | |
| 6,895,791 | B2 | 5/2005 | Alexander et al. | |
| 6,926,318 | B2 | 8/2005 | Oxley | |
| D512,297 | S | 12/2005 | Metivier et al. | |
| D520,848 | S | 5/2006 | Metivier et al. | |
| 7,144,053 | B2 | 12/2006 | Bashford | |
| 7,209,029 | B2 | 4/2007 | Coelho et al. | |
| 7,221,272 | B2 | 5/2007 | Hosselet | |
| 7,336,150 | B2 | 2/2008 | Gokcebay et al. | |
| 7,397,343 | B1 | 7/2008 | Gokcebay et al. | |
| D580,837 | S | 11/2008 | Kluck | |
| 7,472,934 | B2 | 1/2009 | Burke et al. | |
| D593,398 | S | 6/2009 | Pelletier et al. | |
| 7,647,797 | B1 | 1/2010 | Viso Cabrera et al. | |
| 7,747,286 | B2 | 6/2010 | Conforti | |
| 7,770,423 | B2 * | 8/2010 | Wu | 70/218 |
| 7,891,222 | B2 * | 2/2011 | Ratkus et al. | 70/278.7 |
| 8,141,400 | B2 * | 3/2012 | Sorensen et al. | 70/279.1 |
| 8,495,898 | B2 * | 7/2013 | Gokcebay | 70/214 |
| 2001/0045112 | A1 | 11/2001 | Berton et al. | |
| 2002/0056300 | A1 | 5/2002 | Pierre et al. | |
| 2004/0003633 | A1 | 1/2004 | Alexander et al. | |
| 2005/0128050 | A1 | 6/2005 | Frolov et al. | |
| 2005/0199026 | A1 | 9/2005 | Geringer et al. | |
| 2005/0253715 | A1 | 11/2005 | Awobue | |
| 2006/0226948 | A1 | 10/2006 | Wright et al. | |
| 2006/0238294 | A1 | 10/2006 | Gokcebay et al. | |
| 2007/0257773 | A1 | 11/2007 | Hill et al. | |
| 2008/0084836 | A1 | 4/2008 | Baird et al. | |
| 2008/0252083 | A1 | 10/2008 | Carabalona | |
| 2009/0058102 | A1 | 3/2009 | Garneau et al. | |
| 2010/0307206 | A1 | 12/2010 | Taylor et al. | |
| 2010/0320971 | A1 | 12/2010 | Zhu et al. | |
| 2011/0012709 | A1 | 1/2011 | Payson et al. | |
| 2011/0056253 | A1 | 3/2011 | Greiner et al. | |
| 2011/0181060 | A1 | 7/2011 | Geringer et al. | |

* cited by examiner

Steps to Open the Lock

Steps to Close the Lock

60

INTERCHANGEABLE ELECTRONIC LOCK

FIELD OF THE INVENTION

The invention relates to locking mechanisms used in filing and storage cabinets, office furniture, storage compartments, including built in cabinets, and other lockable storage units.

BACKGROUND OF THE INVENTION

Many furniture manufacturers and their customers desire electronic locking mechanisms that use a keypad or other electronic means, such as an RFID Card reader or other security scanner, rather than traditional mechanical locks, to access and secure their office furniture and other kinds of storage units.

Electronic locks in the prior art have been used to provide secure storage and access control in office furniture, storage cabinets and other compartments. These prior art locks have special latching mechanisms and housings which require the furniture manufacturers and others to make tooling changes to their furniture or make other potentially time consuming, difficult, and costly adaptations to accept the special locking mechanisms and housings of these prior art locks as replacements for pre-existing locking systems.

By way of example, FIG. 1 in published US Patent Application 2011 0056253 shows such an electronic lock with a unique housing and latching apparatus. FIGS. 1, 2, 3 and 4 of U.S. Pat. No. 6,655,180 also show an electronic lock with a unique housing and latching system requiring custom installation.

Similarly FIG. 5 of U.S. Pat. No. 5,886,644 shows a unique installation of outer and inner housings for an electronic lock.

Furthermore, neither of these locks can be used with lateral filing cabinets or pedestal drawers because they cannot be easily adapted to existing central locking systems.

Canadian Patent No. 2,388,230 shows an example of a mechanical lock used in a central locking application for a lateral filing cabinet or other storage unit. In FIGS. 1 and 2 of that Patent, the mechanical lock is shown with a zigzag shaped lock shaft and a round retainer. The illustrated lock shaft is connected to a locking core which is included in a standard "Double D" lock housing unit. An example of this mechanical lock is shown as being installed in a conventional 2 drawer locking cabinet.

Prior art locking systems come in various shapes, sizes and configurations. Many of these prior art locking systems include multi component drawer slide locking arrays.

Therefore, it is desirable to provide a new electronic locking system that is conveniently interchangeable with existing mechanical locks without requiring costly tooling changes by office furniture manufacturers, and without using difficult or complicated installation procedures by installers, customers or other users.

By way of example, it is preferable that an electronic lock include a replaceable or interchangeable driver selected from a group of preselected drivers of different shapes, sizes, and configurations, the group being compatible for use with a plurality of tenons, cranks, linkage bars and other components in locking systems which are widely used in many standard locking applications within the industry.

SUMMARY OF THE INVENTION

In one aspect, an electronic lock is designed to be installed in a storage unit. When installed, the electronic lock is operationally associated with a locking assembly (for example, a locking bar assembly) for locking and unlocking a storage unit (for example, storage units suitable for one or more storage compartments). In this aspect, the electronic lock includes a lock housing which can be releasably secured to the storage unit. The electronic lock may be adapted for use in retrofit installations, as a replacement for previously installed locks, or as an original equipment manufacturers' (OEM) component.

Various features and components may be used to releasably secure the electronic lock housing to a storage unit. Fasteners, couplings, quick connect and other elements may be provided to secure the electronic lock, yet allow the manufacturer, installer or other user to remove the electronic lock, if replacement, repair or removal for some other reason, is desired.

It is preferable that the housing is replaceable or interchangeable with other housings selected from a group of preselected housings of different shapes, sizes, and configurations, the group being compatible for use with a plurality of other locking systems which are widely used in many standard locking applications within the industry.

The electronic lock includes a driver to operationally engage the locking assembly. Typically, the driver moves between a first driver position and a second driver position. In the first driver position, the locking assembly is in the locked position. In the second driver position, the locking assembly is in the unlocked position.

Preferably, the driver is replaceable or interchangeable with other drivers selected from a group of preselected drivers of different shapes, sizes, and configurations, the group being compatible for use with a plurality of tenons, cranks, linkage bars and other components in locking systems which are widely used in many standard locking applications within the industry.

A drive shaft assembly is protected in the housing. The drive shaft assembly is adapted to be selectively and operationally engaged with the driver. For example, an operator may select a locked position for the electronic lock in which the drive shaft assembly will not activate the locking assembly in the storage unit. In one mode, such as for example, when the electronic lock is in the locked position, the drive shaft assembly is operationally disengaged from the driver so that the driver is unable to lock or unlock the locking assembly in the storage unit. Similarly, by way of example, the operator may select an unlocked position for the electronic lock in which the drive shaft assembly may be operationally engaged with the driver, so that the operator may manually unlock the locking assembly.

The electronic lock includes a gear segment assembly which moves between a first gear segment position and a second gear segment position. In the first gear segment position, the drive shaft assembly is operationally disengaged from the driver. In the second gear segment position, the drive shaft assembly is operationally engaged with the driver.

The electronic lock also includes an electronic access control to operate the gear segment assembly between the first gear segment position and the second gear segment position. The electronic access control will, often, but not necessarily, include an operator activation device such as a programmable keypad or a programmable access card reader (for example, an RFID card reader). The electronic access control may include an electric motor in combination with a rechargeable or replaceable battery power source. The electric motor may be used to move the gear segment assembly to the second gear segment position, so that the operator may operationally engage the driver, to, in turn, operate the locking assembly between a first position in which the locking assembly is "locked" (for example, to prevent opening of the storage unit) and a second position in which the locking assembly is unlocked (so that the locking assembly may be moved by the operator, between the locked and unlocked positions).

In a preferred embodiment, when the electronic lock is in the unlocked mode, and the electric motor has moved the gear segment assembly to the second gear position, the operator may manually operate the driver by rotational movement, or other movement, of the drive shaft assembly. Preferably, the motor may be used sparingly to operate the gear segment assembly, without operating the entire drive shaft assembly, to reduce power consumption and thus, prolong battery life, or reduce the frequency of battery recharging or replacement.

A port, such as a USB port, may be provided to allow convenient recharging of a suitable rechargeable battery and to allow data storage, data access or exchange with the electronic access control.

The electronic lock in this aspect also includes a manual activation assembly which is operationally connected to the driver when the gear segment assembly is in the second gear segment position. In this mode, the operator may manually operate the driver between the first driver position and the second driver position. In a preferred embodiment, the manual activation assembly includes a manually operated knob which the operator may rotate, to move the drive shaft assembly and to operate the driver so that the locking assembly may be operated between its locked position and its unlocked position.

The manual activation assembly may also provide a bypass feature. In certain situations, for example, when the motor in the electronic access control is not operational (or for administrative convenience), the bypass feature may be activated to permit the operator to manually operate the drive shaft assembly, without using the motor to move the gear segment assembly to the second gear segment position. In some instances, the bypass feature may allow the operator to manually move the gear segment assembly to the second gear segment position (for example, when the motor is not operational). In other embodiments, the bypass feature may allow the operator to activate other elements to operationally engage the drive shaft assembly with the driver. In some instances, the bypass feature may operationally engage the drive shaft assembly with the driver without activating or moving the gear segment assembly to the second gear segment position.

For example, in some embodiments, the bypass feature may include a key activated locking core to operationally engage the drive shaft assembly with the driver, without moving the gear segment assembly. The operating key may be inserted by the operator into the locking core, to turn the drive shaft assembly, and in turn, move the driver so that the locking assembly in the storage unit may be moved between the locked and unlocked positions.

In another aspect, an electronic lock operates between a locked position and an unlocked position, to allow an operator to lock and unlock a storage unit. In this aspect, the electronic lock comprises:

- A lock housing which may be used to secure the electronic lock to the storage unit;
- A driver which operationally engages with a locking assembly in the storage unit to lock and unlock the locking assembly;
- A drive shaft assembly which is located in the housing to selectively and operationally engage with the driver;
- An electronic access control which operates a gear segment assembly. The gear segment assembly operates between a first gear segment position and a second gear segment position. In the first gear segment position, the drive shaft assembly is operationally disengaged from the driver when the electronic lock is in the locked position. In the second gear segment position, the drive shaft assembly is operationally engaged with the driver when the electronic lock is in the unlocked position; and
- A manual activation assembly which is operationally connected to the driver when the gear segment assembly is in the second gear segment position. When the gear segment assembly is in the second gear segment position, an operator may manually operate the driver between the first driver position and the second driver position.

In yet another aspect, an electronic lock operates between a locked position and an unlocked position to lock and unlock a locking assembly in a storage unit. In this aspect, the electronic lock may include:

- A lock housing for secure releasable engagement with the storage unit;
- A drive shaft in the housing, in which the drive shaft includes:
  - A first shaft segment secured to a removable driver for engagement with the locking assembly;
  - A second shaft segment which is operationally disconnected from the first shaft segment in a first mode, and the second shaft segment is operationally connected to the first shaft segment in a second mode;
- An electronic access control to operate a gear segment assembly between a first gear segment position and a second gear segment position; in the first gear segment position, the second shaft segment is operationally disconnected from the first shaft segment; in the second gear segment position, the second shaft segment is operationally connected to the first shaft segment;
  - The electronic access control may include:
    - a programmable keypad or a card reader to activate a battery powered motor for operation of the gear segment assembly between the first gear segment position and the second gear segment position; and
- A third shaft segment which may be provided in a manual activation assembly for manual rotational operation of the drive shaft when (a) the gear segment assembly is in the second gear segment position, or (b) the manual activation assembly is in a bypass mode to operate the first shaft segment without activating the battery powered motor.

By way of example, in some embodiments, the third shaft segment may include a keyed locking core configured to operate the drive shaft without activating the electronic access control or without drawing power from a battery power source to operate an electric motor or other electronic components. In other embodiments, the third shaft segment may be configured to operate separately from the manual activation assembly. In some instances, one or more of the shaft segments may be constructed from multiple components or pieces.

There are other possible embodiments of these aspects which may include interchangeable drivers, interchangeable housings, electronic access control features which may include a programmable keypad, a programmable card reader, a manual bypass feature, and one or more of the other features described elsewhere within this specification. An optional modular chassis assembly may also be provided in which a removable array of components are assembled in a modular format for testing, maintenance, repair, convenience, or improved quality control during assembly of the electronic lock. A preferred embodiment of the invention is described having regard to the following drawings.

Other aspects of the invention will become apparent to those persons who are skilled in the art upon reading the following detailed description, drawings and appended claims.

BRIEF DESCRIPTION OF THE DRAWINGS

FIG. 6-1 shows examples of fully assembled Electronic Locks with different embodiments of the Lock Drive Shaft.

FIG. 6-2 shows examples of different embodiments of the Lock Drive Shaft.

FIG. 7-1 shows the steps to open an embodiment of the Electronic Lock.

FIG. 7-2 shows the steps to close an embodiment of the Electronic Lock.

FIG. 8-1 shows a partial interior view of the illustrated embodiment of the Electronic Lock in the Fully Locked Position.

FIG. 8-2 shows a partial interior view of the illustrated embodiment of the Electronic Lock as the Motor begins to rotate.

FIG. 8-3 shows a partial interior view of the illustrated embodiment of the Electronic Lock after the motor is fully rotated and the Manual Knob is ready to be turned.

FIG. 8-4 shows a partial interior view of the illustrated embodiment of the Electronic Lock as the user begins turning the Manual Knob.

FIG. 8-5 shows a partial interior view of the illustrated embodiment of the Electronic Lock in the fully opened position.

FIG. 10-1 shows an exploded front view, in perspective, of a modular chassis assembly in the Electronic Lock.

FIG. 10-2 shows an exploded rear view, in perspective, of the modular chassis assembly illustrated in FIG. 10-1.

FIG. 10-3 shows a front view, in perspective, of the assembled modular chassis assembly illustrated in FIGS. 10-1 and 10-2.

FIG. 11-1 shows a front view of a partial section, in perspective, of the modular chassis assembly, when the key and the locking core are partially rotated.

FIG. 11-2 shows a rear view of a partial section, in perspective, of the modular chassis assembly, when the key and the locking core are partially rotated as illustrated in FIG. 11-1.

FIG. 12-1 shows a front view of a partial section, in perspective, of the modular chassis assembly, when the key and the locking core are rotated 180 degrees in a clockwise direction.

FIG. 12-2 shows a rear view of a partial section, in perspective, of the modular chassis assembly, when the key and the locking core are rotated 180 degrees as illustrated in FIG. 12-FIG. 13-1 shows a front view, in perspective, of the locking core assembled with the inner cam.

FIG. 13-2 shows an exploded front view, of the locking core and the inner cam illustrated in FIG. 13-1.

FIG. 13-3 shows a rear view of the locking core, and a front view of the inner cam, to illustrate the mating features of these two components.

FIG. 15-1 is a plan view of selected components in the modular chassis assembly, illustrating the interaction between the drive gear assembly and a visual indicator, showing the position of drive gear assembly.

FIG. 15-2 is a rear view, in perspective, of the selected components in the modular chassis assembly, illustrated in FIG. 15-1.

DESCRIPTION OF A PREFERRED EMBODIMENT OF THE INVENTION

Figure 1:
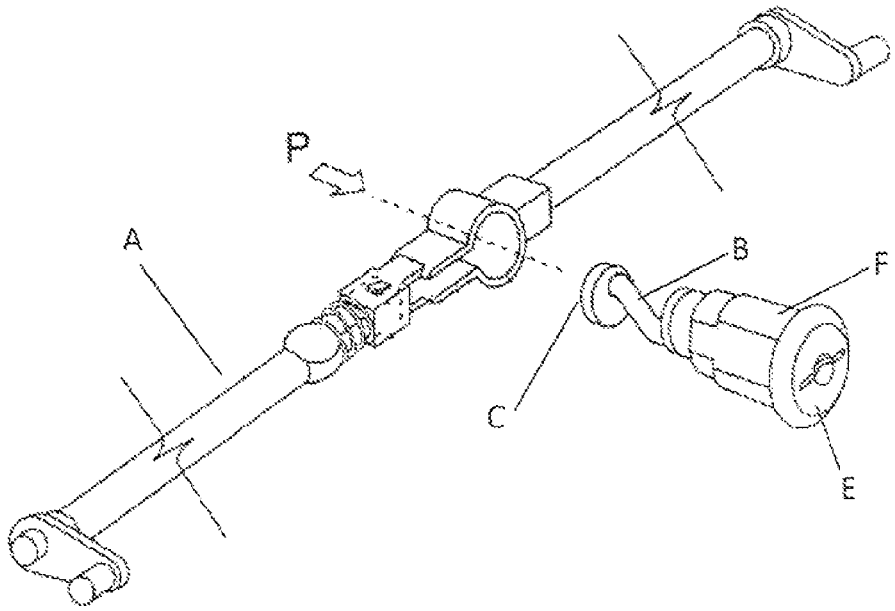
Fig. 1 Prior Art
FIG. 1 shows one embodiment of the prior mechanical locks.
Figure 2:
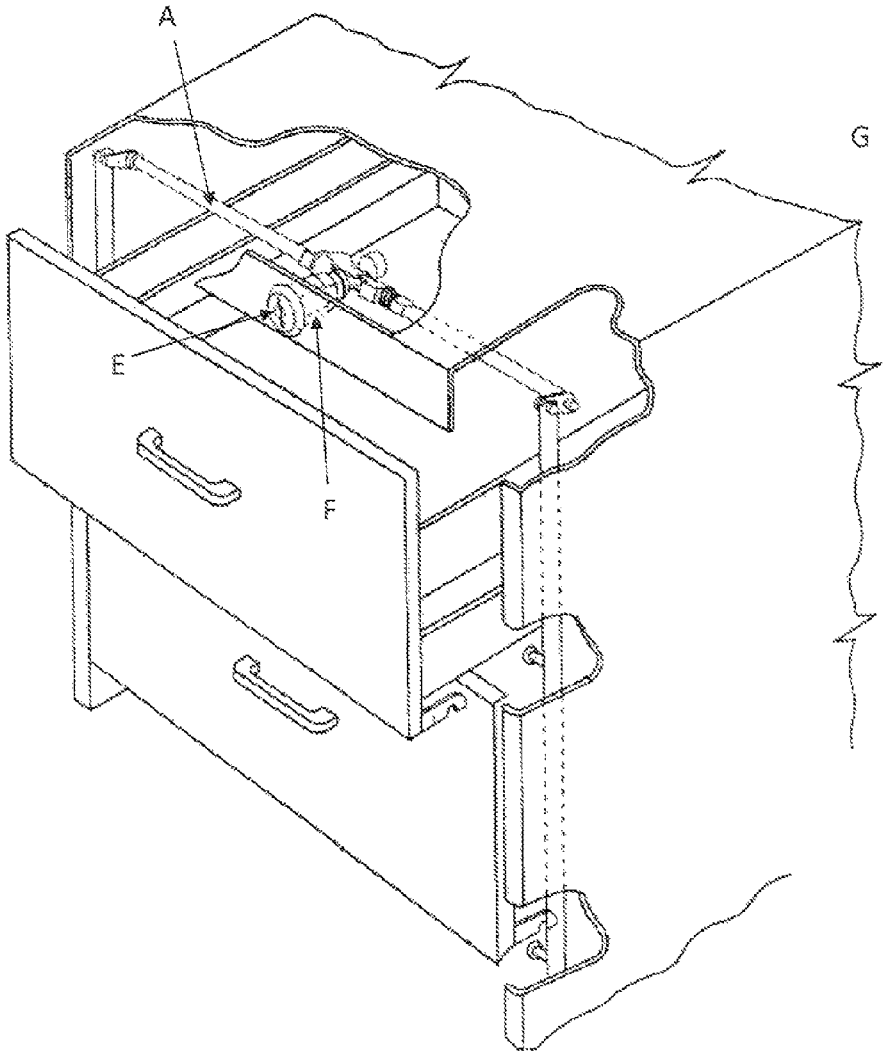
Fig. 2 Prior Art
FIG. 2 shows the prior mechanical lock of FIG. 1 as used in a central locking application for a lateral filing cabinet.

FIG. 1 and FIG. 2 show an embodiment of a prior art latching system illustrated and described in Canadian Patent No. 2,388,230. FIG. 1 and FIG. 2 show one embodiment of an irregularly shaped driver B having a retainer C which is generally circular in cross-section. The mechanical locking system shown in this patent includes a crank arm A with a zigzag configuration. This crank arm A is connected to a key operated locking core E which is included in a standard "Double D" lock housing unit F. This mechanical lock is shown installed in a conventional two drawer locking cabinet G.

Electronic locks of the prior art are not readily or easily adapted for retrofit installation in storage units fitted with prior art latching systems.

FIGS. 3 to 15-2 show a preferred embodiment of the present invention.

Figure 3:
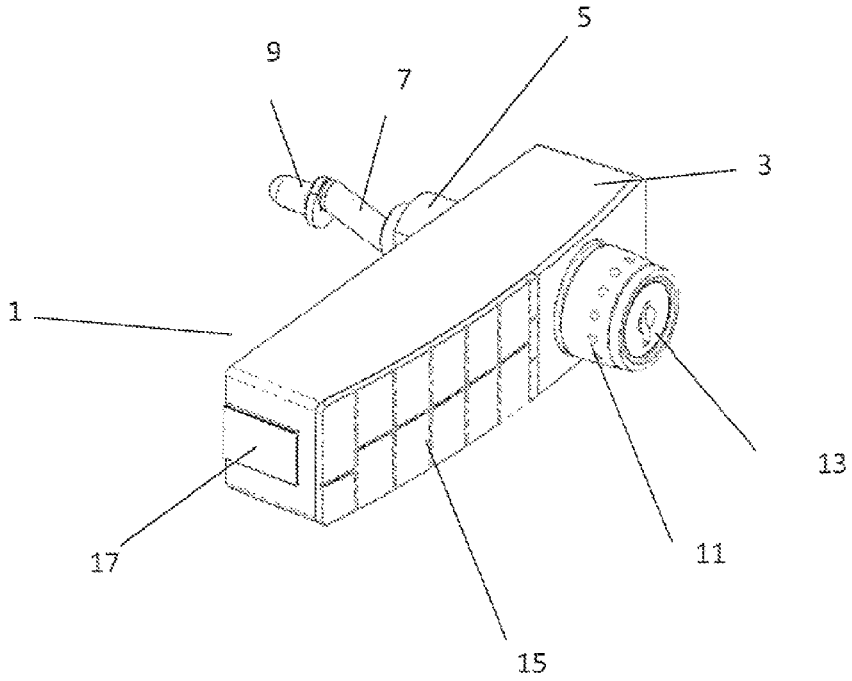
FIG. 3 shows fully assembled preferred embodiment of the Electronic Lock of the present invention.
Figure 4:
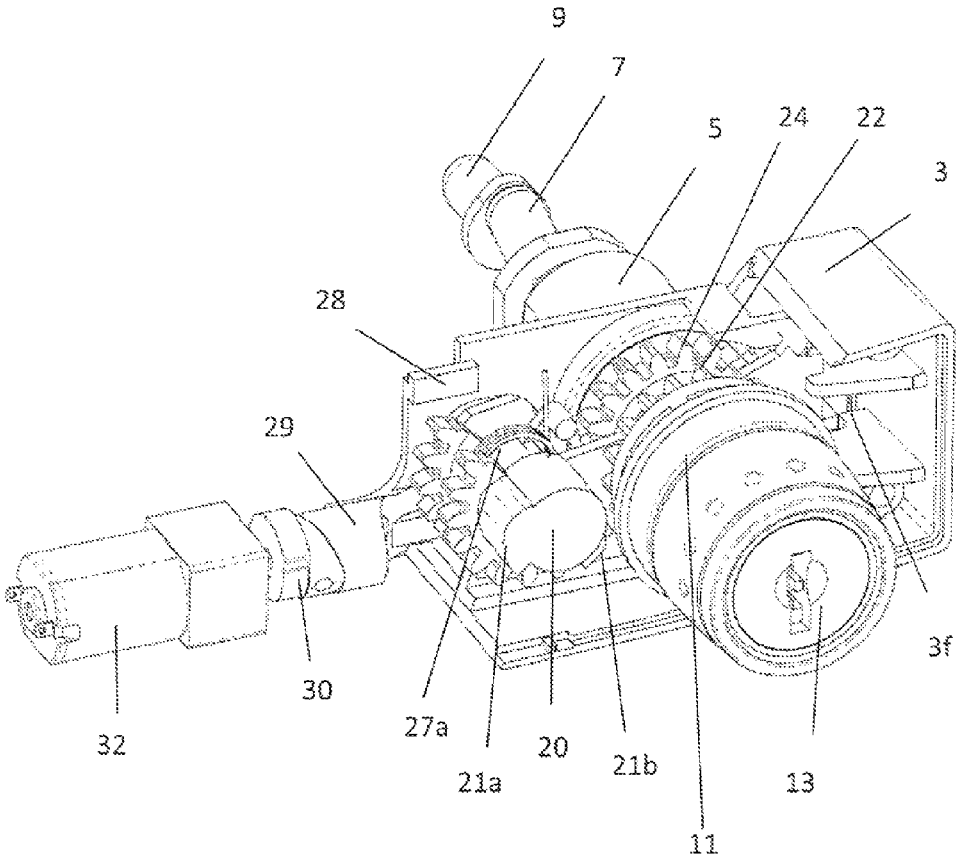
FIG. 4 shows a partial interior view of the Electronic Lock of FIG. 3 to illustrate an example of the Motor and Gear Assembly.
Figure 5:
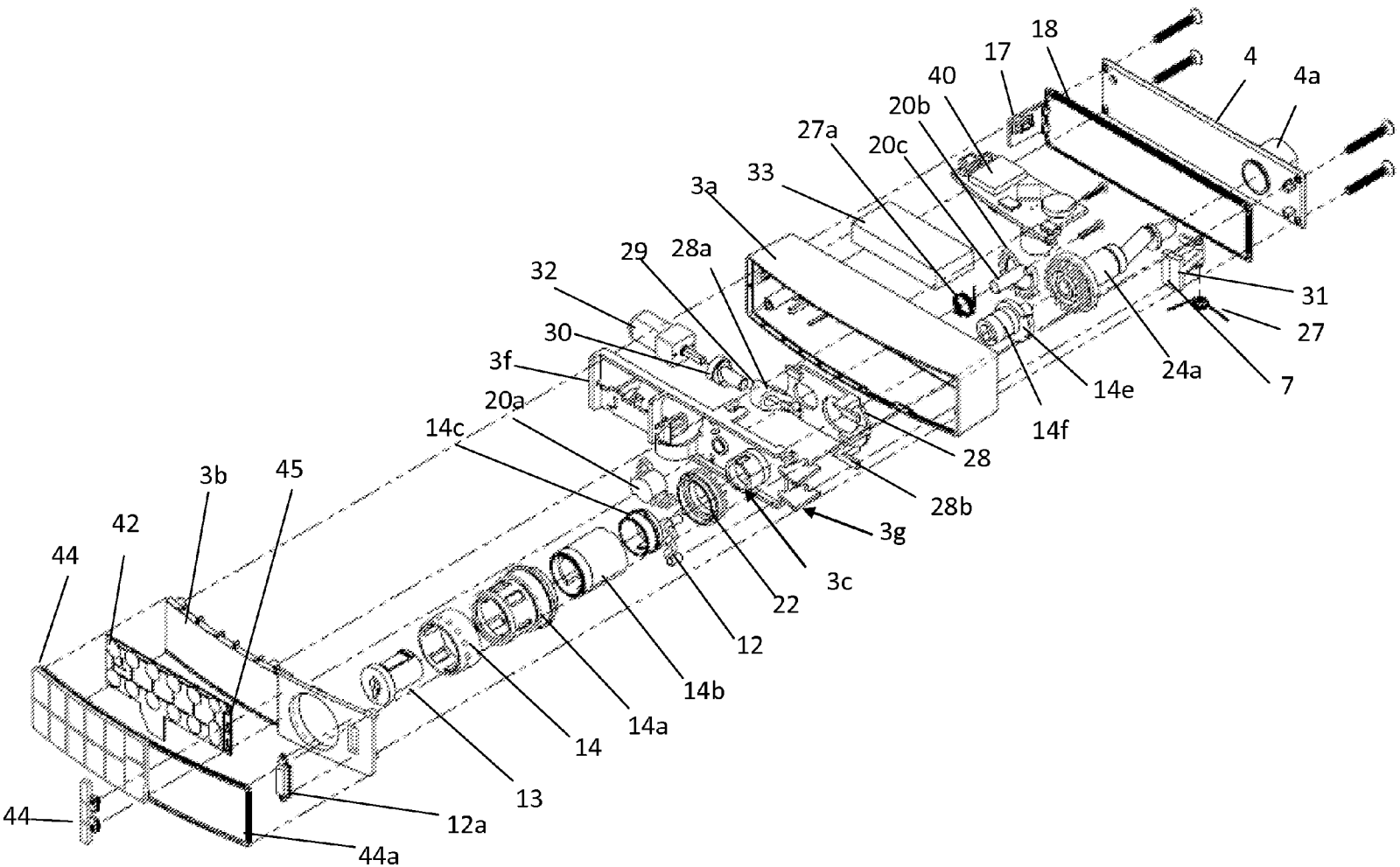
FIG. 5 shows an exploded view of the preferred embodiment of the Electronic Lock.

FIG. 3 shows an exterior view of an electronic lock 1, FIG. 4 shows a partial section of the electronic lock 1, and FIG. 5 shows an exploded view of the electronic lock. The electronic lock 1 includes a lock housing 3 with a standard "Double D" configuration lock housing insert 5. The lock housing 3 includes a housing frame 3*a* connected to a housing front plate 3*b*. (Persons skilled in the art will appreciate that gaskets and additional protective features may be provided between interconnecting components, to protect against dirt, moisture and other potentially damaging hazards. One or more of these optional features may be provided, where needed or desired, as a matter of design choice.)

The lock housing insert 5 extends from the interchangeable rear housing plate 4 of the lock housing 3. The lock housing insert 5 is configured to fit within a corresponding opening with a like configuration in a storage unit. The lock housing insert 5 may be cast with the rear plate 4 as one piece. In other embodiments, the lock housing insert 5 may be a separate piece 4*a* secured (in some other manner) to a suitable back plate piece.

A drive shaft 7 extends rearwardly from the lock housing 3 toward the interior of a storage unit (not shown). A driver 9 extends from the distal end of the drive shaft 7. The driver 9 is provided to connect with a locking system in a storage unit (which may be similar to an existing unit similar to the locking system described in Canadian Patent No. 2,388,230. Preferably, the driver 9 is interchangeable with other replacement drivers. A substitute driver may be attached to a suitably configured drive shaft segment which may also differ in configuration from the drive shaft 9 illustrated in FIG. 3.

Different drive shaft configurations may be accommodated within the interior of the lock housing 3. The drive shaft, driver and housing components may be interchangeable with other replacement components to allow the electronic lock 1 to be interchangeable with comparable mechanical locks or other electronic locks. The interchangeability of these components enhances the adaptability of the electronic lock system for simplified repairs and replacements of existing locks and in OEM manufacture.

A keypad 15 is provided as part of an electronic access control situated on the proximate face of the electronic lock 1. In this embodiment, keypad 15 includes an external protective keyboard membrane 44 and a front gasket 44*a*. The keypad 15 supports the entry of pass codes and programming commands via a keyboard circuit 42 into the memory element included in circuit board 40 by regular users and master users. Indicator light array 45 is connected to the circuit board and the power supply, to notify the operator of one or more status indicators associated with the maintenance and operation of the electronic lock. A USB port and cover 17 are provided on the side face of the lock housing 3. The USB port may be provided to facilitate recharging of the interior power storage (battery 33) used to power the electronic components of the electronic lock 1 including a battery powered rotary motor 32. In this embodiment, the USB port cover 17 is shown as a flexibly hinged attachment to a protective gasket 18 positioned between the interchangeable housing rear plate 4 and the housing frame 3*a*.

A manual knob assembly 11 surrounds a rotatable bypass (override) key core 13. The manual knob assembly 11 includes a knob grip 14 which extends outwardly from the housing front plate 3*b*. The knob grip 14 is secured to a manual knob 14*a* which partially extends inwardly, away from the front plate 3*b*. When the knob grip 14 is secured to the manual knob 14*a* (for example, in a snap fit configuration), the manual knob assembly 11 is rotatably secured to the housing front plate 3*b*. In other embodiments comprising a lock housing 3*a*, a dummy plug (not shown) may be permanently installed so that a keyed bypass feature is not available. Some customers may wish to avoid the risk of the keyed lock being picked and therefore those customers may choose to decline the keyed bypass feature.

The knob barrel 14*b* nests within knob 14*a*, and knob barrel cap 14*c* is positioned within knob barrel 14*b*, in a predetermined alignment so that the matched internal channels and abutments may selectively engage with the locking core 13 in the event that the operator chooses to operate the manual knob assembly in a manual override mode. The manual knob assembly 11 engages with a front drive gear 22 mounted about the knob barrel cap 14*c*, both of which are mounted on a fixed collar 3*c* projecting in a forward direction from the chassis 3*f* located within the housing frame 3*a*. Inner cam 14*f* is positioned rearwardly of the chassis 3*f*. The inner cam 14*f* extends through the interior channel of the collar 3*c*.

Figures 1, 10:
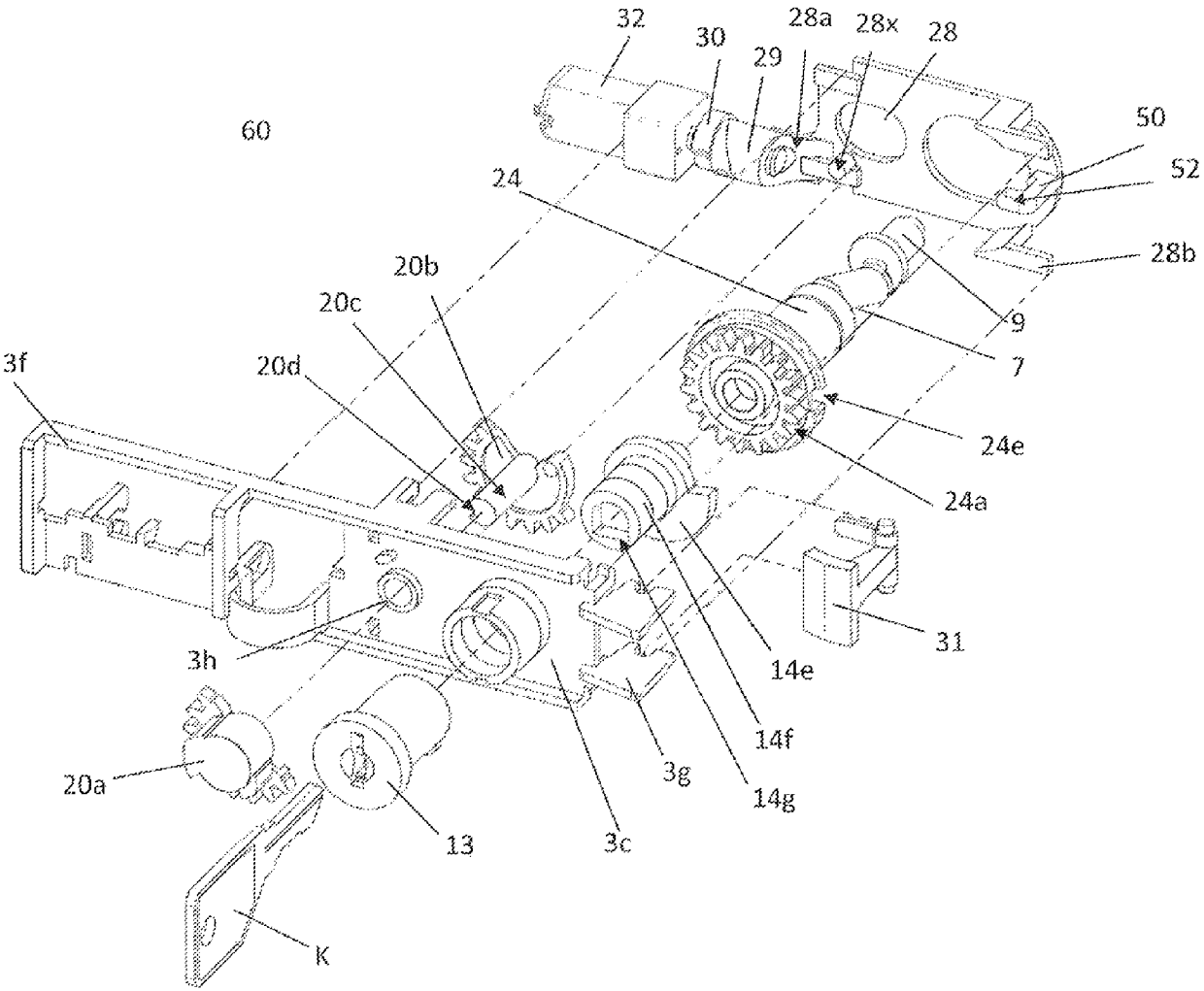
Figures 2, 10:
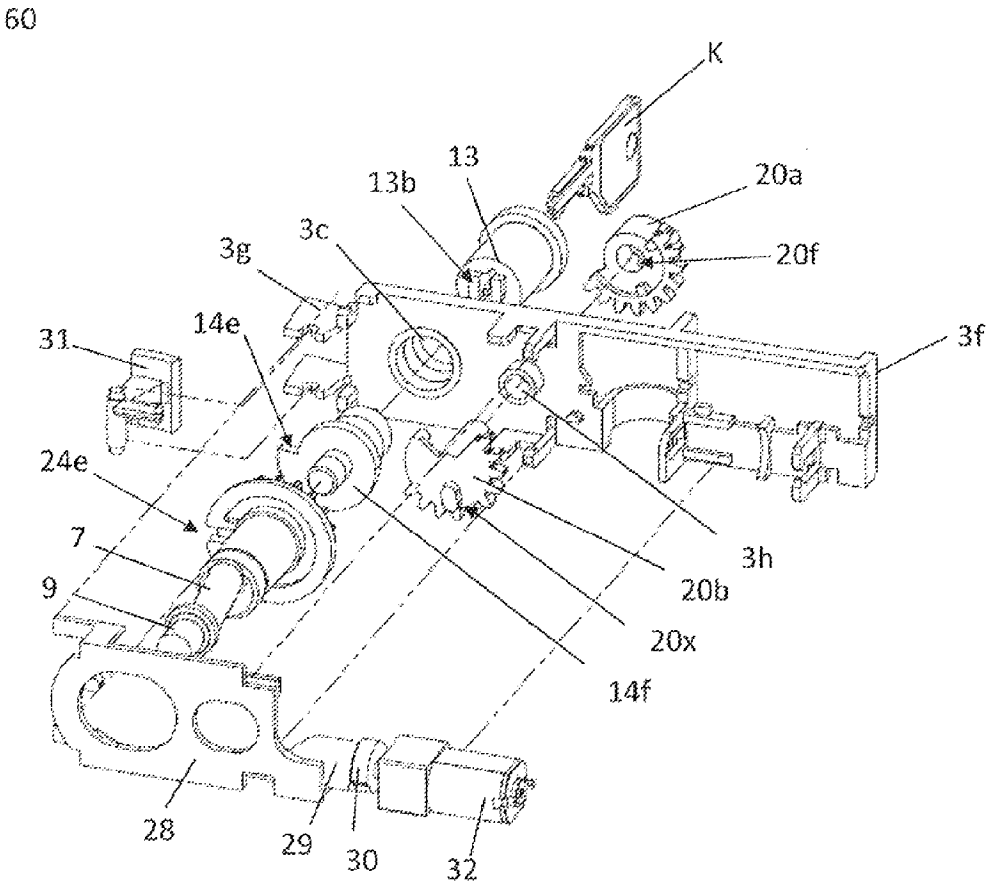
Figures 3, 10:
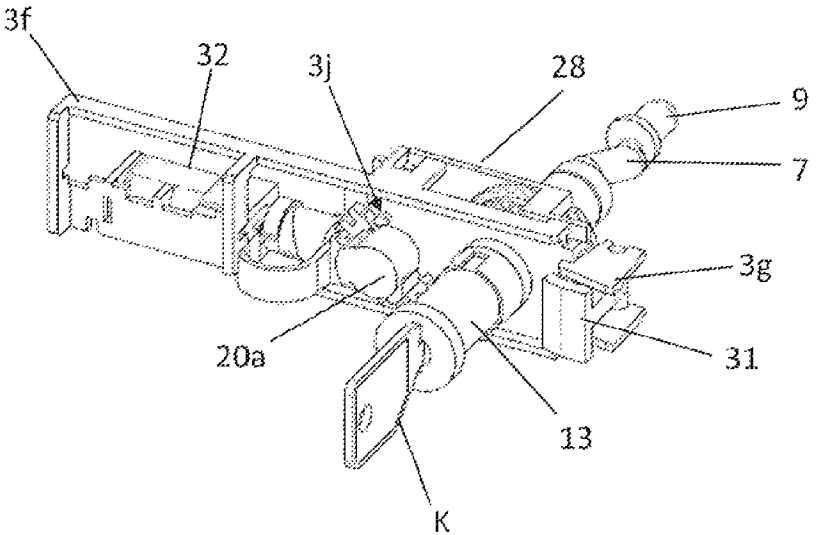

FIGS. 10-1 to 10-2 illustrate a modular chassis assembly 60. An optional chassis 3*f* is provided so that the motor 32, circuit board 40, gears and other parts may be easily assembled outside of the housing 3. An optional modular chassis assembly 60 may be utilized to obtain one or more of the following advantages, or other advantages which will be apparent to those skilled in the art:

- To manage or accommodate production tolerances and to improve the alignment of parts and micro switches during assembly;
- To permit convenient testing of modular assemblies within the lock assembly, and preferably, the circuit board, battery and motor, prior to installation into the housing. This also allows for convenient replacement of faulty parts prior to final assembly.
- To simplify assembly and installation steps so that any parts designated for association with the modular chassis assembly 60 may be snapped into (or otherwise connected to) the chassis 3*f*, for subsequent installation into the housing 3.

When the electronic lock 1 is in a locked state, the manual knob assembly 11 and the drive shaft 7 are not engaged and will not permit operation of the driver 9. In the disengaged state, the manual knob 14*a* spins freely.

Figures 1, 15:
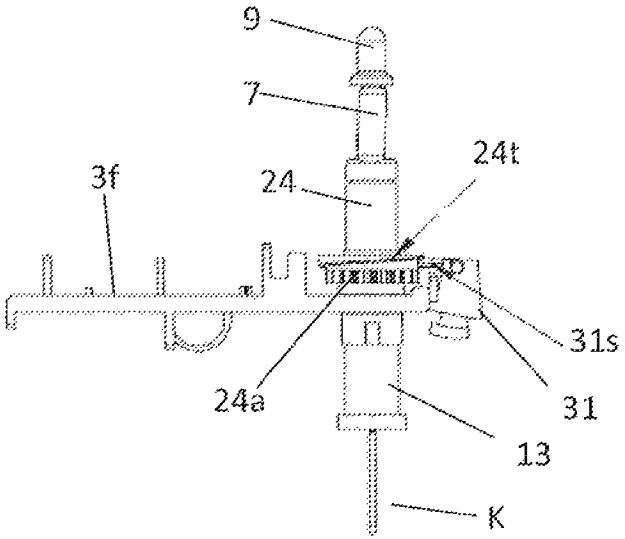
Figures 2, 15:
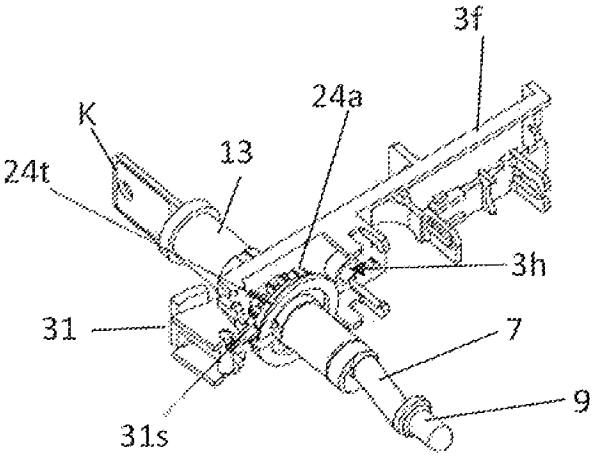

Once the appropriate passcode has been successfully entered and accepted by the software, the motor 32 begins to rotate. Ramped collar cam 30 which is mounted on the motor shaft also rotates. This collar cam 30 interacts with the ramped follower surface 29*a* on the first slider cam 29 so that as the collar cam 30 rotates, the slider 28 is urged away from the collar cam 30. This linear movement of the slider 28 displaces the locking dog 50 in the second slider cam 28*b*, to disengage locking dog 50 from recess 24*e* in rear drive gear 24*a*, to unlock and permit manual rotation of the drive shaft 7. The slider lobe 28*c* engages gear lobe 20*x*, when the slider 28 is displaced, to rotate the front and rear gear segments 20*a*, 20*b*, so that the gear segments 20*a*, 20*b* are aligned for engagement with the front drive gear 22 and rear drive gear 24*a*. When the knob 14 is turned, the gears 20*a*, 20*b*, 22, and 24*a* are meshed and the drive shaft 7 also turns. As shown in FIGS. 15-1 and 15-2, the ramped surface 24*t* on the rear drive gear 24*a*, engages indicator tab 31*s* (configured to act as a cam follower, along ramped surface 24*t*), to pivotally displace the indicator 31, to show that the lock is in the open position, or in the closed position, as the case may be.

The gear segment assembly 20 includes a front gear segment 20*a* located forward of the chassis 3*f* and a rear gear segment 20*b* located rearward of the chassis 3*f*. A gear segment sleeve 20*c* extends through an aperture 3*h* in chassis 3*f* to connect front gear segment 20*a* to rear gear segment 20*b*. Torsion spring 27*a* urges the gear segment assembly 20 in a preferred direction, preferably to hold the gear segment assembly 20, in a starting position, abutting against rest 3*j*, when the gear assembly 20 is disengaged from the corresponding gears of the front drive assembly 14*d* and the rear drive gear assembly 24 when the electronic lock is in the locked position. In this embodiment the front drive assembly 14*d* includes front drive gear 22 and parts 14, 14*a*, 14*b*, and 14*c*. The rear drive gear assembly includes rear drive gear segment 24*a*.

Front gear segment 20*a* includes a first cam segment 21*a* and a second cam segment 21*b*. Cam segments 21*a* and 21*b* interact with the drive gear assembly, during rotation of the drive gear assembly, to activate control switches which interact with the motor, during the opening and closing steps of the electronic lock.

When the manual knob assembly 11 and the gear assembly 20 are operationally engaged and the manual knob assembly 11 is turned, the drive shaft 7 also turns. The user turns the manual knob assembly 11 through 180 degrees to open a matched locking assembly (not shown) within a storage unit (not shown). This manual action provides the power to lift locking bars, rotate cams and other locking features without electrical power. This optional power saving feature allows an operator to apply manual power to perform these steps thereby reducing the power draw from the battery 33.

The electronic lock 1 supports an optional manual override key K. The override key K bypasses the keypad 15 and allows the manual knob assembly 11 to be turned in operational engagement with the drive shaft assembly after the override key has been turned.

When tumblers (not shown) in the locking core 13 are key activated, they engage with the internal channels and abutments of the manual knob assembly 11 to enable the bypass (override) option, allowing the operator to operationally engage the drive shaft assembly and rotate it upon rotation of the locking core 13 and the manual knob assembly 11.

With reference to FIGS. 10 to 14, the lock core 13 has a horseshoe shaped extension 13*b* on its rear face which latches, in a slide-fit, with a corresponding, horseshoe shaped slot 14*g* on inner cam 14*f*. When the key K is inserted into the lock core 13, and the key K and lock core 13 are turned, the inner cam 14*f* also turns. The inner cam surface 14*e* acts against the cam follower 52 on the slider 28. This manual action moves the slider 28 in the same direction as the motor 32 would move the slider 28, if the motor 32 were used to operate the drive shaft 7 rather than the manual bypass. This movement of the slider 28 displaces the locking dog 50 on the second slider cam 28*b*, to disengage locking dog 50 from locking recess 24*e*, thereby unlocking the rear drive gear segment 24*a* and the drive shaft 7 so that the drive shaft 7 and the driver 9 may be rotated. The slider lobe 28*x* engages gear lobe 20*x*, when the slider is displaced, to rotate the front and rear gear segments 20*a*, 20*b*, so that the gear segments 20*a*, 20*b* are aligned for engagement with the front drive gear 22 and rear drive gear 24*a*. When the knob 14 is turned, the gears 20*a*, 20*b*, 22, and 24*a* are meshed and the drive shaft 7 also turns. As shown in FIGS. 15-1 and 15-2, the ramped surface 24*t* on the rear drive gear 24*a*, engages indicator tab 31*s* (configured to act as a cam follower, along ramped surface 24*t*), to pivotally displace the indicator 31, to show that the lock is in the open position, or in the closed position, as the case may be. The indicator tab 31*s* is kept in contact with the ramped surface 24*t* by a torsional spring 27 (shown in FIG. 5).

Figures 1, 11:
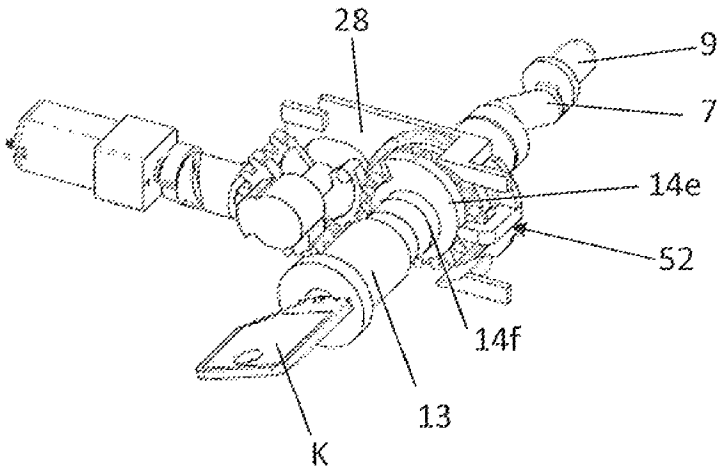
Figures 2, 11:
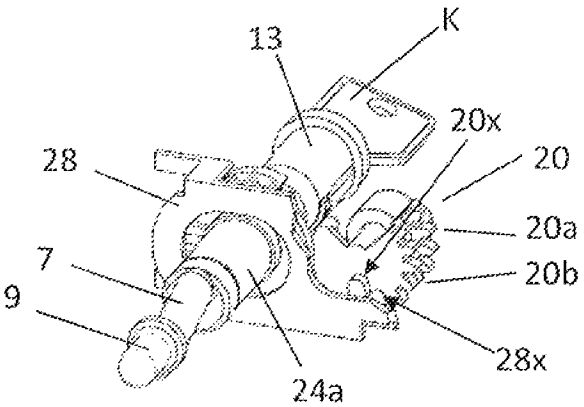
Figures 1, 12:
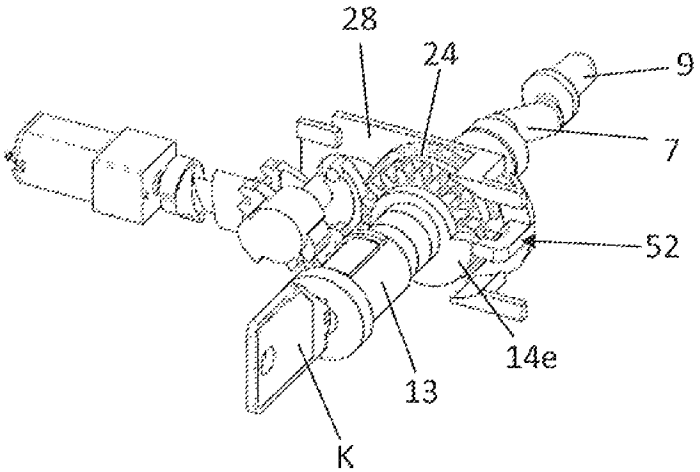
Figures 2, 12:
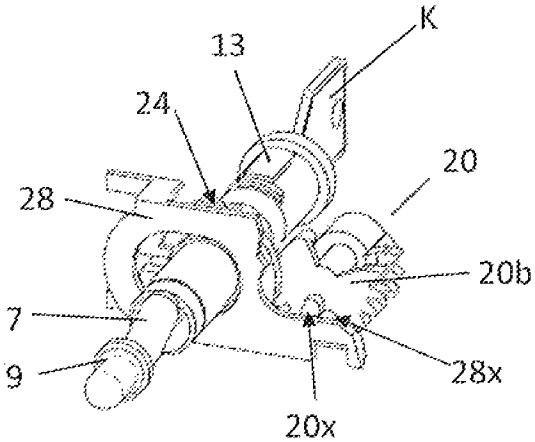
Figures 1, 13:
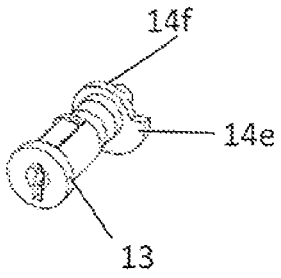
Figures 2, 13:
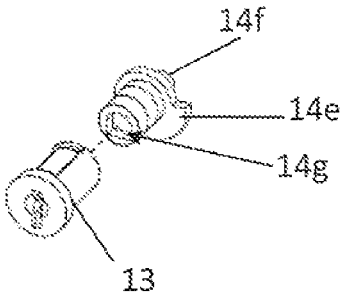
Figures 3, 13:
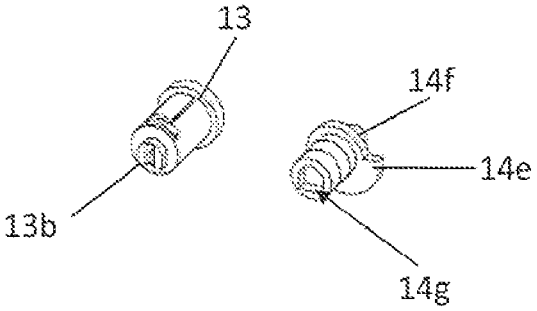

FIGS. 11-1 and 11-2 show partial sectional views of select components of the manual override system, as the key K is partially rotated. As the key K is rotated (along with the lock core 13), the inner cam 14*f* pushes the slider 28 outwardly from the rear drive gear, to disengage the dog 50 from recess 24*e*. At the same time, the slider lobe 28*x* engages the gear lobe 20*x*, to initiate rotation of the gear segments 20*a*, 20*b*. As the key K is rotated 180 degrees, as shown in FIGS. 12-1 and 12-2, the inner cam 14*f* continues to push the slider 28 outwardly away, to engage gear segments 20*a*, 20*b*, with gears 22, 24*a*.

An index spring 12 acts as a detent so the user can feel discrete clicks as the manual knob assembly 11 is rotated to advance through the operational steps of locking and unlocking.

In this embodiment, the indicator 31 is used to show different colours in the window lens 12*a* corresponding to the rotational position of the manual knob assembly 11 and whether the driver 9 has opened or closed the locking assembly. Torsion spring 27 urges the indicator 31 in a preferred direction to indicate the status of the electronic lock 1. These different colours provide the user with a visual cue showing the status of the electronic lock and its corresponding affect on the locking assembly in the storage unit: (i) fully opened, (ii) fully closed or (iii) manual knob assembly 11 is partially turned.

The electronic lock is readily adapted for use with various locking systems and storage units. A variety of interchangeable drive shafts and drivers may be provided with the electronic lock. The drive shafts and drivers are designed to fit with pre-existing locking components or standard OEM parts used by furniture manufacturers and the like. In addition, interchangeable lock housings of different configurations may be provided. For example, with regard to the example of the standard "Double D" lock housing, an opening of the same size and corresponding configuration is provided by furniture manufacturers in their furniture to accept a standard mechanical lock with a Double D mechanical lock housing. The electronic lock is easily adapted to be surface mounted on the furniture so that the housing insert 4*a* may be inserted as a replacement into a corresponding opening in an existing storage unit, including office furniture, fitted with a standard mechanical lock with a Double D housing.

The electronic lock is easily adapted to be installed into an existing central locking system of a storage unit in exactly the same manner as an existing mechanical lock. In a preferred embodiment, The back plate of the lock housing assembly is first mounted within the gable of the cabinet structure using a hex nut, spring clip or other means suitable to secure the housing back plate to the structure. For convenience, a template may be provided to locate a single drill hole for a mounting screw (not shown) on the cabinet structure to match a threaded opening or other fastening feature on the lock. The hole may be drilled in the cabinet (or other structure) and the screw may be threaded through the drilled hole and into the electronic lock housing to ensure that the housing does not rotate or move relative to the structure after installation. Provided that the appropriate housing insert, drive shaft and driver configurations have been selected, the installer should be able to install the electronic lock without other tooling changes.

The central locking system is installed in the same manner and configuration as with a mechanical lock.

Figure 6:
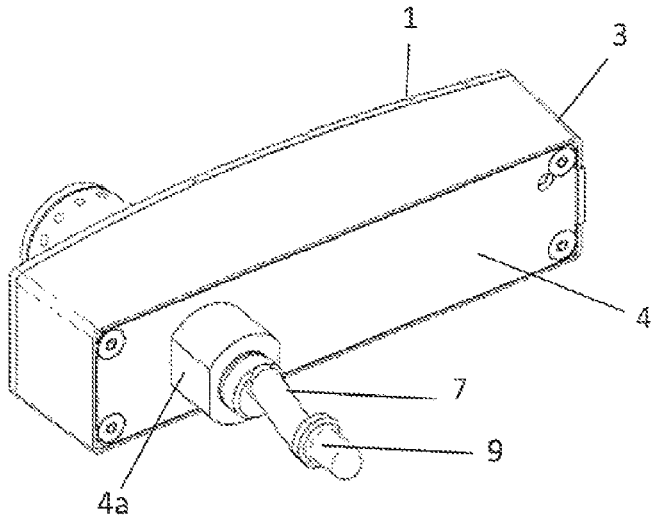
Figure 1:
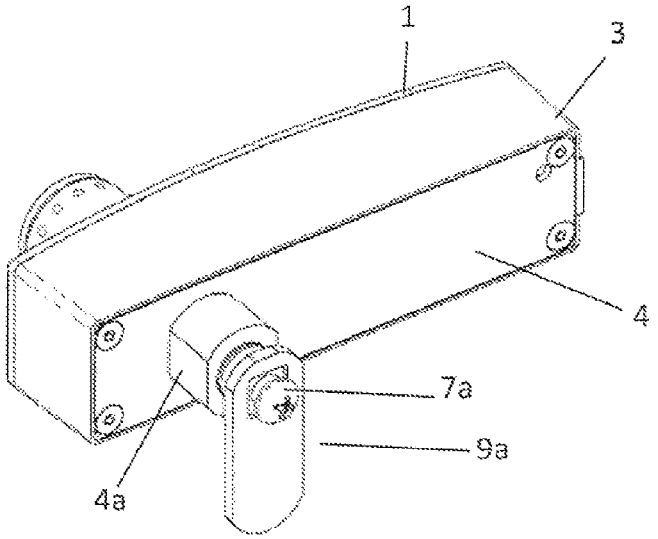
Figures 2, 6:
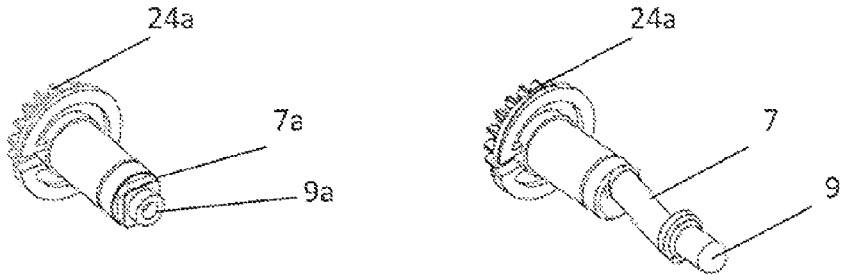

In different embodiments, the lock drive shaft and or driver may be replaced with a plurality of shapes and sizes such as square, horseshoe or other configurations. FIG. 6-1 and FIG. 6-2 illustrate two examples of two drive shafts 7,7*a* fitted with driver configurations 9,9*a*. A variety of locking cam configurations may be affixed to, or incorporated into, the end of a driver to suit many specific locking requirements of office furniture manufacturers and other manufacturers. A locking cam may be affixed to a driver or drive shaft with a hex nut or other suitable means. For example, driver cam 9*b* is shown as one embodiment of a removable cam feature. In some instances, it may also be convenient to provide a drive shaft segment, driver and cam element which may be manufactured as a single work piece.

Opening the Lock

Figures 1, 7:
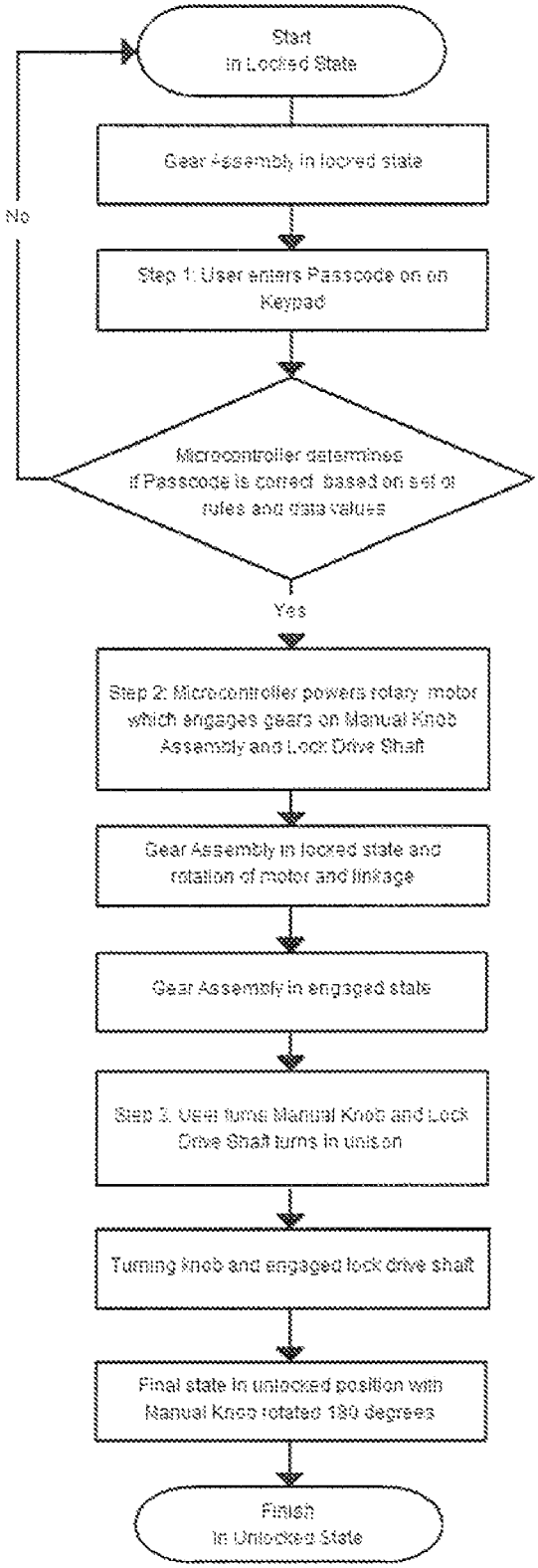
Figures 2, 7:
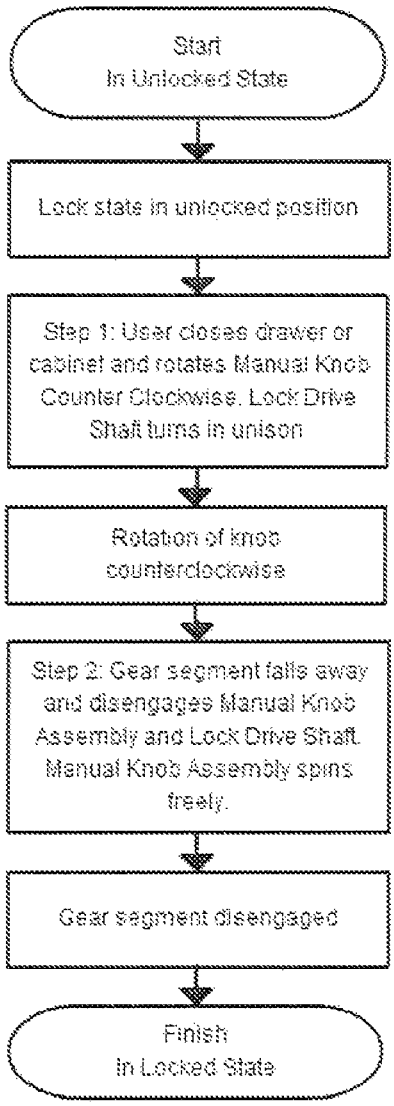

FIG. 7-1 shows an example of the logical steps taken to open the electronic lock.

Figures 1, 8:
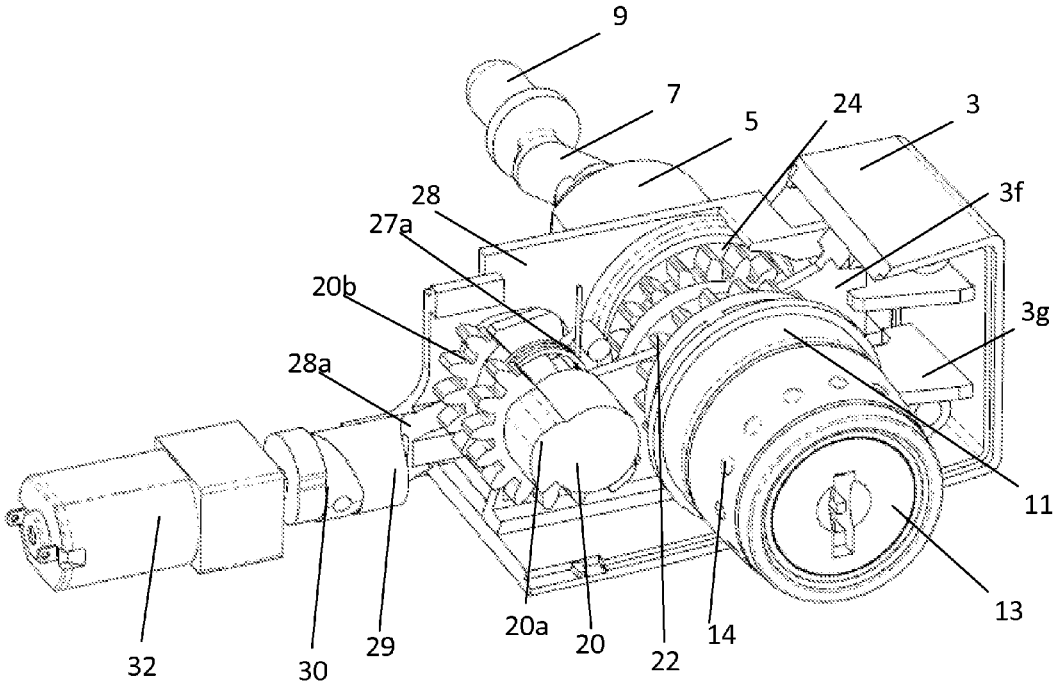
Figures 2, 8:
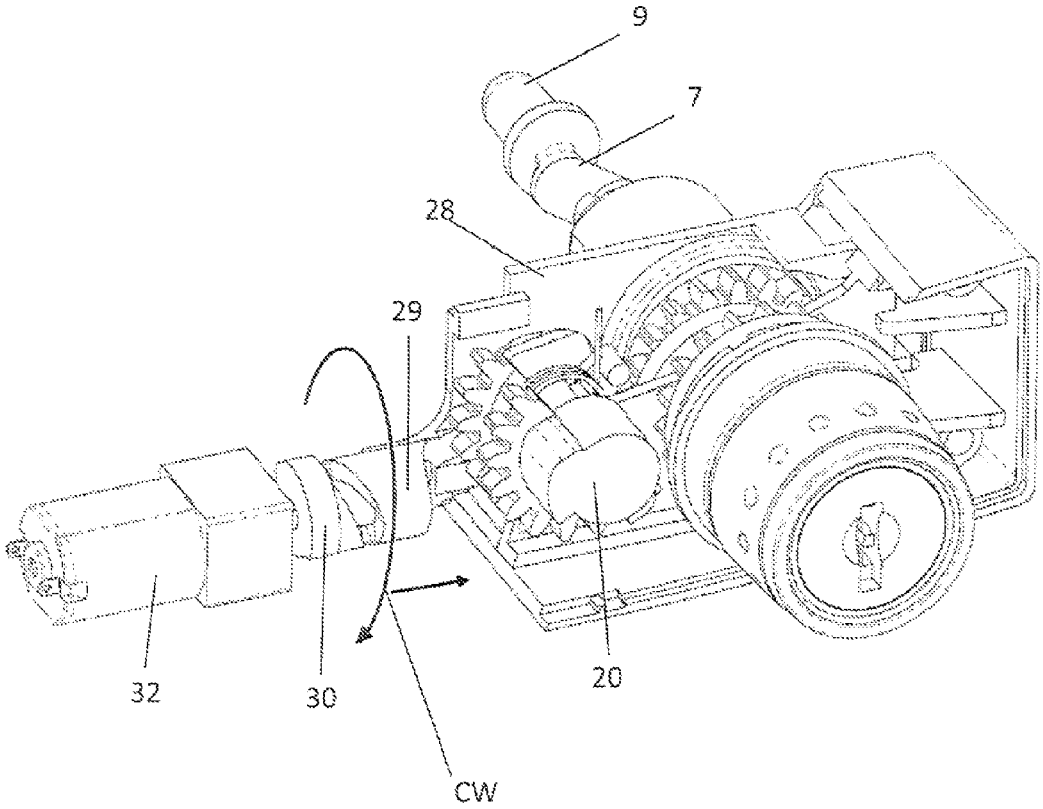
Figures 3, 8:
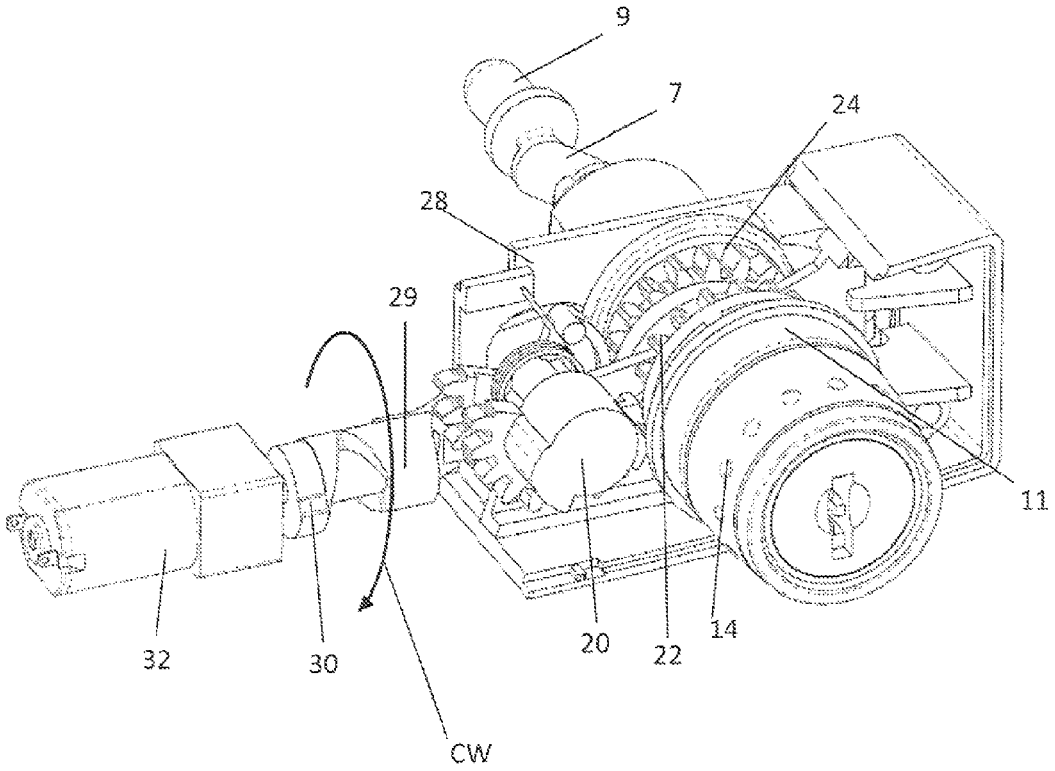
Figures 4, 8:
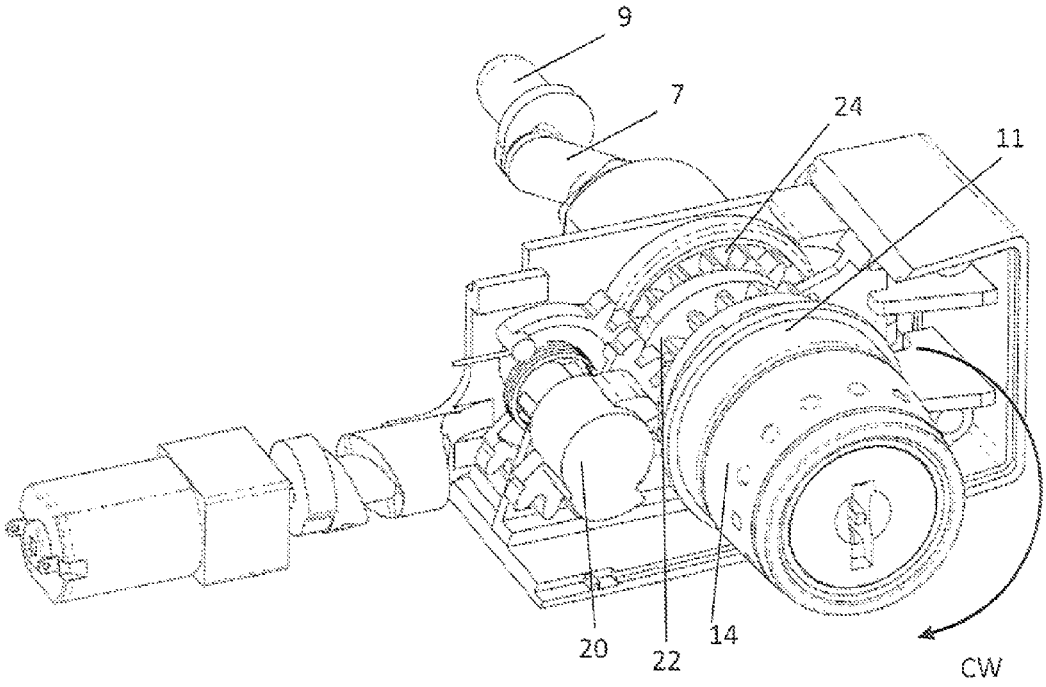
Figures 5, 8:
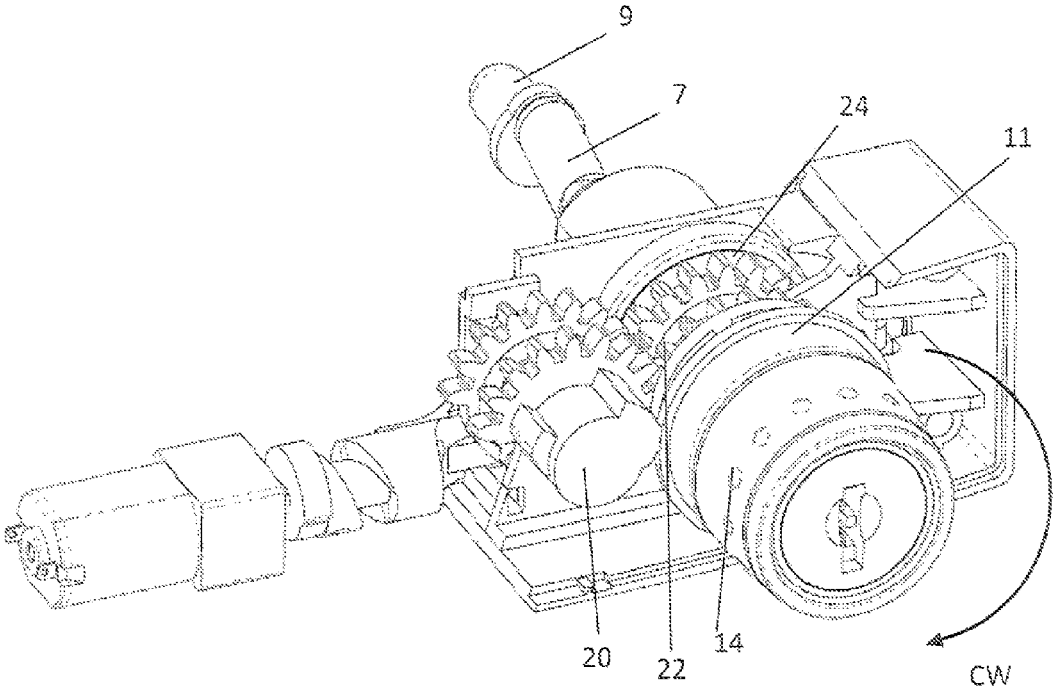

The electronic lock 1 is initially in the locked state as shown in FIG. 8-1. The torsion spring 27*a* biases the gear segment assembly 20 away from the rear drive gear assembly 24 associated with the drive shaft and away from the front drive gear 22 of the front drive assembly 14*d* associated with the manual knob assembly 11. In this state, the manual knob spins freely and does not engage with the drive shaft. The slider 28 also retains the drive shaft in a fixed position so that it cannot rotate when the lock is in the locked position.

Step 1

The user enters a pass code on the keypad which is validated by the microcontroller against the data stored in the database. The data includes a pass code and other pre selected information, for example, the time of day. If the pass code is valid, then power is applied to the motor to engage the gear segment assembly to engage the manual knob assembly with the drive shaft.

Step 2

FIG. 8-2 shows the assembly as the motor 32 begins to rotate. As power is applied to the motor 32, the motor 32 and collar cam 30 rotate in a clockwise direction. The collar cam moves the slider 28 which engages the gear segment assembly 20 with drive gears 22, 24*a* (to connect drive assemblies 14*d*, 24) and unlocks the drive shaft to allow manual rotation.

FIG. 8-3 shows the assembly with the various gears fully engaged and the manual knob assembly is ready for manual rotation.

Step 3

Once the gear segment assembly 20 is engaged with both drive gears 22, 24*a* (e.g., the gear segments from the rear drive gear assembly 24 and the front drive assembly 14*d* associated with the manual knob assembly 11), the user can now turn the manual knob assembly 11 to open the locking assembly (for example, a locking bar assembly) in the storage unit. FIG. 8-4 shows the electronic lock assembly as the user commences rotation of the manual knob assembly 11.

FIG. 8-5 shows the lock in the fully opened position after the manual knob assembly has been turned 180°.

Closing the Lock

FIG. 7-2 shows the steps to close and lock the electronic lock.

FIG. 8-5 shows the lock in the fully opened position.

Step 1

Figure 9:
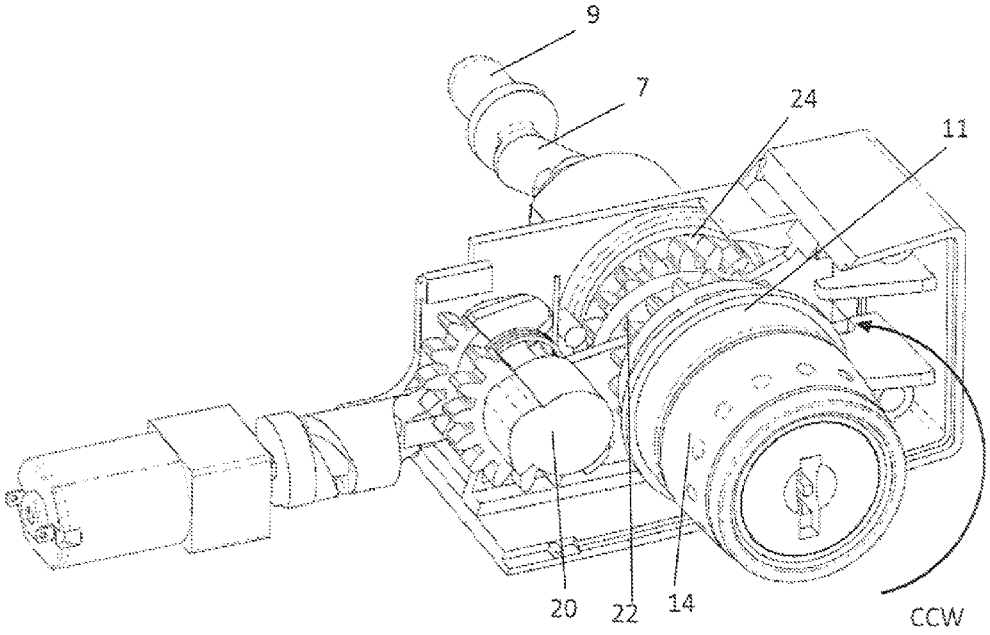
FIG. 9 shows a partial interior view of the illustrated embodiment of the Electronic Lock as the user begins the locking operation.

The user then closes a drawer or door (not shown) on the storage unit (for example, in a furniture cabinet) and turns the manual knob assembly 11 through 180° in a counter clockwise direction. This action is shown in FIG. 9.

Step 2

As the user continues to turn the manual knob assembly 11 fully through 180°, the gear segment assembly 20 disengages and falls away and is biased away by the torsion spring 27*a*. In Step 2, the electronic lock is in the fully locked position shown in FIG. 8-1.

Many other variations and modifications of the invention are also possible. The preferred embodiment of the invention has been described with regard to the appended drawings. It will be apparent to those skilled in the art that additional embodiments are possible and that such embodiments will fall within the scope of the appended claims.

| PARTS LIST | |
|---|---|
| Prior Art | |
| FIG. 1 and FIG. 2 | |
| A | crank arm |
| B | irregularly shaped driver |
| C | retainer |
| E | locking core |
| F | lock housing unit |
| G | two drawer locking cabinet |
| Embodiments of the Invention | |
| FIG. 3 | |
| 1 | electronic lock |
| 3 | lock housing |
| 5 | "Double D" shaped housing insert |
| 7 | drive shaft |
| 9 | driver |
| 11 | manual knob assembly |
| 13 | bypass (override) key core |
| 15 | keypad |
| 17 | USB port and cover |
| FIG. 4 | |
| 20 | gear segment assembly |
| 21a | first cam segment |
| 21b | second cam segment |
| 22 | front drive gear |

-continued

| PARTS LIST | |
|---|---|
| 24 | rear drive gear assembly |
| 27a | torsion spring |
| 28 | slider |
| 29 | first slider cam |
| 30 | collar cam |
| 32 | motor |
| FIG. 5 | |
| 3a | housing frame |
| 3b | housing front plate |
| 3c | collar |
| 3f | chassis |
| 3g | mounting bracket |
| 4 | interchangeable housing back plate |
| 4a | "Double D" shaped housing plug insert |
| 12 | index spring |
| 12a | window lens |
| 14 | knob grip |
| 14a | knob |
| 14b | knob barrel |
| 14c | knob barrel cap |
| 14d | front drive assembly |
| 14e | inner cam surface |
| 14f | inner cam |
| 17 | USB port cover |
| 18 | USB gasket |
| 20a | front gear segment |
| 20b | rear gear segment |
| 20c | gear segment sleeve |
| 22 | front drive gear |
| 24a | rear drive gear segment |
| 27 | (second)torsion spring |
| 27a | torsion spring |
| 28a | second ramped surface on slider cam 29 |
| 28b | second slider cam |
| 29 | first slider cam |
| 31 | indicator |
| 33 | battery |
| 40 | circuit board |
| 42 | keypad circuit |
| 44 | keypad membrane |
| 44a | gasket |
| 45 | indicator light array |
| FIG. 6-1 | |
| 1 | electronic lock |
| 3 | lock housing |
| 4 | housing back plate |
| 4a | "Double D" shaped housing plug insert |
| 7 | drive shaft |
| 7a | shortened drive shaft |
| 9 | driver (illustrated as a cammed driver) |
| 9a | embodiment of an alternative driver base |
| FIG. 8-1 | |
| See above | |
| FIG. 8-2 | |
| CW | clockwise rotation |
| FIG. 8-3 | |
| See above | |
| FIG. 8-4 | |
| $CW_1$ | clockwise rotation |
| FIG. 8-5 | |
| $CW_2$ | clockwise rotation |
| FIG. 9 | |
| CCW | counter clockwise rotation |
| FIGS. 10-1 to 10-3 | |
| K | key |
| 3h | aperture |
| 3j | positioning rest |
| 13b | horseshoe shaped extension |
| 14g | irregular slot |

-continued

Figure 14:
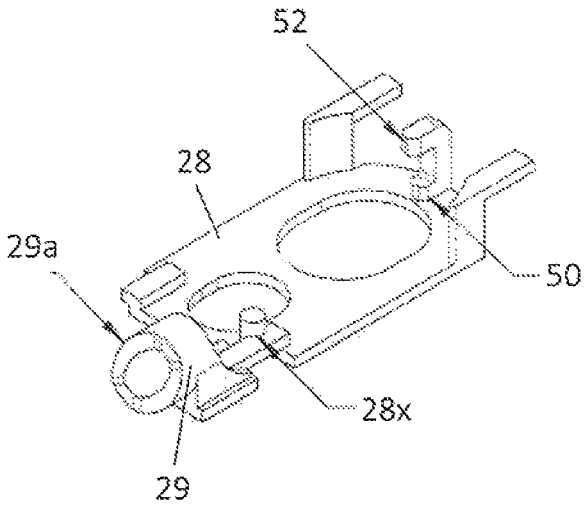
FIG. 14 is a perspective detail view of the slider cam included in the modular chassis assembly illustrated in FIGS. 11-1 to 11-3.

| PARTS LIST | |
|---|---|
| 20d | channel |
| 20x | gear lobe |
| 24e | recess |
| 28x | slider lobe |
| 50 | dog |
| 52 | cam follower |
| 60 | modular chassis assembly |
| FIG. 14 | |
| 29a | ramped follower |
| FIGs 15-1, 15-2 | |
| 24t | ramped surface |
| 31s | indicator tab (cam follower) |

We claim:

1. An electronic lock for operational association with a locking assembly for locking and unlocking a storage unit, the electronic lock comprising:

A lock housing for releasably securing the electronic lock to the storage unit;

A driver for operating engagement with the locking assembly; the driver moving between a first driver position and a second driver position; in the first driver position, the locking assembly is in the unlocked position; and, in the second driver position, the locking assembly is in the locked position;

A drive shaft assembly in the housing for selective operational engagement with the driver;

A gear segment assembly moving between a first gear segment position and a second gear segment position, in the first gear segment position the drive shaft assembly is operationally disengaged from the driver, in the second gear segment position the drive shaft assembly is operationally engaged with the driver;

An electronic access control to operate the gear segment assembly between the first gear segment position and the second gear segment position; and A manual activation assembly operationally connected to the driver when the gear segment assembly is in the second gear segment position, for manual operation of the driver between the first driver position and the second driver position.

2. In the electronic lock claimed in claim 1, the drive shaft assembly operating between a first drive shaft assembly position and a second drive shaft assembly position, the driver is operationally disengaged from the drive shaft assembly in the first drive shaft assembly position, and the driver is manually operable in the second drive shaft assembly position.

3. In the electronic lock claimed in claim 1, the electronic access control comprising an electric motor powered by a rechargeable power source, the electric motor is operationally connected to the gear segment assembly upon activation of the electronic access control.

4. In the electronic lock claimed in claim 3, the electric motor is used to move the gear segment assembly between the first gear segment position and the second gear segment position.

5. In the electronic lock claimed in claim 4, the electronic access control comprising:

a programmable keypad for operator activation of the electric motor to move the gear segment assembly between the first gear segment position and the second gear segment position after entering a security code; or a security scanner for operator activation of the electric motor to move the gear segment assembly between the first gear segment position and the second gear segment position after presentation of a security access card.

6. In the electronic lock claimed in claim 3, the electronic access control comprising a port for (a) recharging the power source; or (b) transferring data to and from a data storage element in the electronic access control.

7. In the electronic lock claimed in claim 1, the manual activation assembly comprising a manually operable shaft segment for selective operational engagement with the drive shaft assembly when the drive shaft assembly is in the second position.

8. In the electronic lock claimed in claim 7, the manual activation assembly comprising a key activated locking core operating between a first key position and a second key position, in the first key position, the manually operable shaft segment is operationally connected to the driver upon activation of the electronic access control, and in the second key position, the manually operable shaft segment is operationally disconnected from the electronic access control, to manually operate the driver.

9. The electronic lock claimed in claim 1, comprising an interchangeable component selected from a group of interchangeable components consisting of: a housing interchangeable with other housings of like configuration and unlike configuration; a driver interchangeable with other drivers of like configuration and unlike configuration; and a drive shaft assembly interchangeable with other driver shaft assemblies of like configuration and unlike configuration.

10. An electronic lock as claimed in claim 1, comprising a modular chassis assembly comprising two or more elements selected from the group of elements consisting of: a motor, a battery, a circuit board, the gear segment assembly, and a locking core for manual operation of the driver between the first driver position and the second driver position.

11. An electronic lock operating between a locked position and an unlocked position, for locking and unlocking a storage unit, the electronic lock comprising:

A lock housing for secure engagement with the storage unit;

A driver for operating engagement with a locking assembly in the storage unit;

A drive shaft assembly in the housing for selective operational engagement with the driver;

An electronic access control to operate a gear segment assembly between a first gear segment position and a second gear segment position; in the first gear segment position the drive shaft assembly is operationally disengaged from the driver when the electronic lock is in the locked position; and in the second gear segment position, the drive shaft assembly is operationally engaged with the driver when the electronic lock is in the unlocked position; and A manual activation assembly operationally connected to the driver when the gear segment assembly is in the second gear segment position, for manual operation of the driver between the first driver position and the second driver position.

12. In the electronic lock claimed in claim 11, the manual activation assembly comprising a manually rotatable shaft segment; the shaft segment is operationally engaged with the driver to permit manual rotation of the drive shaft assembly when the gear segment assembly is in the second gear segment position; and the shaft segment is operationally disengaged from the driver when the gear segment assembly is in the first gear segment position.

13. In the electronic lock claimed in claim 11, the electronic access control comprising:

a programmable keypad for operator activation of an electric motor to move the gear segment assembly between the first gear segment position and the second gear segment position after entering a security code; or a security scanner for operator activation of the electric motor to move the gear segment assembly between the first gear segment position and the second gear segment position after presentation of a security access card.

14. In the electronic lock claimed in claim 13, the housing defining a face comprising the programmable keypad or the security scanner; and a distal end, opposite the face, to releasably secure the housing to the storage unit.

15. In the electronic lock claimed in claim 11, the electronic access control comprising a battery powered motor to operate the gear segment assembly between the first gear segment position and the second gear segment position.

16. In the electronic lock claimed in claim 11, the manual activation assembly comprising a manual bypass feature comprising a key activated locking core for rotating the gear segment assembly between the first gear segment position and the second gear segment position, to permit an operator to lock and unlock the locking assembly in the storage unit by rotating the locking core.

17. The electronic lock claimed in claim 16, comprising an interchangeable components selected from a group of interchangeable components consisting of: a housing interchangeable with other housings of like configuration and unlike configuration; a driver interchangeable with other drivers of like configuration and unlike configuration; and a drive shaft interchangeable with other driver shafts of like configuration and unlike configuration.

18. The electronic lock claimed in claim 16 comprising an indicator to alert an operator that:

The electronic lock is in the locked position or in the unlocked position;

The electronic lock is not in a fully locked position or a fully unlocked position;

The storage unit is in the locked or unlocked position; or

A power source for the motor is substantially empty.

19. An electronic lock as claimed in claim 11, comprising a modular chassis assembly comprising one or more elements selected from the group of elements consisting of: a motor, a battery, a circuit board, the gear segment assembly, and a locking core for manual operation of the driver between the first driver position and the second driver position.

20. An electronic lock operating between a locked position and an unlocked position, for locking and unlocking a locking assembly in a storage unit, the electronic lock comprising:

A lock housing for secure releasable engagement with the storage unit;

A drive shaft in the housing, the drive shaft comprising:

A first shaft segment secured to a removable driver for engagement with the locking assembly;

A second shaft segment, is operationally disconnected from the first shaft segment in a first mode, and operationally connected to the first shaft segment in a second mode;

An electronic access control to operate a gear segment assembly between a first gear segment position and a second gear segment position; in the first gear segment position, the second shaft segment is operationally disconnected from the first shaft segment; in the second gear segment position, the second shaft segment is operationally connected to the first shaft segment;

The electronic access control comprising:

a programmable keypad or a security scanner to activate a battery powered motor for operation of the gear segment assembly between the first gear segment position and the second gear segment position; and A third shaft segment in a manual activation assembly for manual rotational operation of the drive shaft when (a) the gear segment assembly is in the second gear segment position, or (b) the manual activation assembly is in a bypass mode to operationally connect the second shaft segment to the first shaft segment without activating the battery powered motor.

21. In the electronic lock claimed in claim 20, the manual activation assembly comprising a key activated locking core for rotating the gear segment assembly, in the bypass mode, between the first gear segment position and the second gear segment position, to permit an operator to lock and unlock the locking assembly in the storage unit by rotating the key activated locking core.

22. A multi compartment storage unit comprising an electronic lock as claimed in claim 20, the electronic lock operationally engaged with the locking assembly, the locking assembly comprising a plurality of sliding lock bars for selectively locking and unlocking an array of storage compartments in the storage unit.

23. An electronic lock as claimed in claim 20, comprising a modular chassis assembly comprising one or more elements selected from the group of elements consisting of: a motor, a battery, a circuit board, the gear segment assembly, and a locking core for manual operation of the driver between the first driver position and the second driver position.

* * * * *